US006718989B1

(12) United States Patent
Clarke et al.

(10) Patent No.: US 6,718,989 B1
(45) Date of Patent: Apr. 13, 2004

(54) FILTER FOR A CIGARETTE AND A FILTER-TIPPED CIGARETTE

(75) Inventors: Paul Clarke, Morpeth (GB); John Charlton, Washington (GB); Ichiro Atobe, Tokyo (JP); Atsushi Tokida, Tokyo (JP)

(73) Assignees: Japan Tobacco Inc., Tokyo (JP); Filtrona International Ltd., London (GB)

( * ) Notice: Subject to any disclaimer, the term of this patent is extended or adjusted under 35 U.S.C. 154(b) by 14 days.

(21) Appl. No.: 09/624,246

(22) Filed: Jul. 24, 2000

(30) Foreign Application Priority Data

Jul. 29, 1999 (GB) ..... 9917820

(51) Int. Cl.[7] ..... A24C 5/50; A24D 1/04

(52) U.S. Cl. ..... 131/339; 131/341; 131/344

(58) Field of Search ..... 131/200, 201, 131/202, 216, 331, 335, 336, 339, 338, 340, 361, 341, 344

(56) References Cited

U.S. PATENT DOCUMENTS

| | | | | | |
|---|---|---|---|---|---|
| 1,718,122 | A | * | 6/1929 | Shon | |
| 1,975,152 | A | * | 10/1934 | Horwitz | |
| 2,695,617 | A | * | 11/1954 | Warnberg | |
| 3,490,461 | A | * | 1/1970 | Osmalov et al. | |
| 3,572,347 | A | * | 3/1971 | Sherril | |
| 3,596,663 | A | * | 8/1971 | Schultz | |
| 3,606,892 | A | * | 9/1971 | Wilson | 131/336 |
| 3,805,800 | A | * | 4/1974 | Summers | 131/336 |
| 4,007,745 | A | * | 2/1977 | Randall et al. | |
| 4,033,362 | A | * | 7/1977 | Almqvist et al. | |
| 4,338,956 | A | * | 7/1982 | Sanford et al. | |
| 4,466,448 | A | * | 8/1984 | Aikman | |
| 4,488,563 | A | * | 12/1984 | Morifuji et al. | |
| 4,492,240 | A | * | 1/1985 | Hayes et al. | 131/336 |
| 4,545,391 | A | * | 10/1985 | Johnson | |
| 4,582,071 | A | * | 4/1986 | Westcott et al. | 131/336 |
| 4,582,072 | A | * | 4/1986 | Sanford | |
| 4,583,560 | A | * | 4/1986 | Sakai et al. | |
| 4,608,999 | A | * | 9/1986 | Johnson | 131/336 |
| 4,620,557 | A | * | 11/1986 | Cantrell et al. | |
| 4,637,409 | A | * | 1/1987 | Berger | 131/198.1 |
| 4,649,943 | A | * | 3/1987 | Gonterman | 131/336 |
| 5,159,940 | A | * | 11/1992 | Hayward et al. | 131/194 |
| 5,178,166 | A | * | 1/1993 | Newsome et al. | |
| 5,568,819 | A | * | 10/1996 | Gentry et al. | 131/331 |
| 5,746,230 | A | * | 5/1998 | Arterbervy et al. | |
| 6,202,650 | B1 | * | 3/2001 | Kaneki et al. | 131/360 |
| 6,345,625 | B1 | * | 2/2002 | Chew | 131/187 |

FOREIGN PATENT DOCUMENTS

| | | | |
|---|---|---|---|
| DE | 3403281 | * | 8/1985 |
| FR | 2373975 | * | 7/1978 |
| FR | 2524775 A | | 10/1983 |
| FR | 2545697 A | | 11/1984 |
| GB | 1360612 | * | 7/1974 |
| GB | 2095532 | * | 10/1982 |
| GB | 2160756 A | | 1/1986 |
| GB | 2161362 A | | 1/1986 |

OTHER PUBLICATIONS

USPTO English Translation of DE 3403281 made Dec. 13, 2002.*

* cited by examiner

*Primary Examiner*—Steven P. Griffin
*Assistant Examiner*—Carlos Lopez
(74) *Attorney, Agent, or Firm*—Birch, Stewart, Kolasch & Birch, LLP

(57) ABSTRACT

A filter for a cigarette and a filter-tipped cigarette having a high degree of freedom in control of filtering-efficiency of smoke are provided. The filter has a core 10 and a sheath 12 made preferably of tow of cellulose acetate fibers. A plurality of axial passages 16 is formed between the core and the sheath and extend continuously between both end faces of the filter.

19 Claims, 6 Drawing Sheets

FILTER FOR A CIGARETTE AND A FILTER-TIPPED CIGARETTE

TECHNICAL FIELD

The present invention relates to a filter for a cigarette, and a filter-tipped cigarette using the filter.

BACKGROUND ART

A cigarette filter is known which has a central axial extending passage therethrough, or which has a plurality of axially extending passages at or in the peripheral portion thereof.

In use, such a filter delivers part of the smoke of the cigarette directly to the smoker through the passage(s). This non-filtered smoke locally spreads in the smoker's mouth, and the smoker can therefore enjoy not only a mild smoking feeling but also the original aroma or flavor of the cigarette, provided that there is an appropriate ratio of the quantity of non-filtered smoke directly delivered to the smoker through the passage(s) to that of filtered smoke delivered to the smoker through a filter material.

This ratio of smoke quantities is greatly influenced by the size of the central passage (or the number and arrangement of the peripheral passages) and the axial air-flow resistance of the filter material. It is therefore desirable to facilitate control of the this ratio. Especially, the quantity of non-filtered smoke directly delivered to the smoker is important for providing the original taste and aroma of the cigarette to the smoker.

The non-filtered smoke in the passage(s) may be diluted by ventilation air introduced from outside to give a milder smoke. However, it is difficult to introduce such ventilation air into a central passage. In a filter having passages located at or close to the outer peripheral surface of the filter, ventilation air from outside can be introduced directly into the passages. In this filter, however, the direct introduction of the ventilation air is apt to alter extremely the axial air-flow resistance of the filter and to give a poor smoking result it is difficult to control precisely the amount of ventilation air (and hence diluting ratio of the non-filtered smoke) whilst keeping the axial air-flow resistance of the filter within a desired range.

The first object of the present invention is to provide a filter for a cigarette and a filter-tipped cigarette which are appropriate for controlling the ratio of the quantity of non-filtered smoke to that of the filtered smoke and suitably deliver a taste and aroma of the cigarette. The second object of the present invention is to provide a filter for a cigarette and a filter-tipped cigarette, which can keep the original taste and aroma of the cigarette and provide a milder smoke.

DISCLOSURE OF THE INVENTION

The first object is achieved by a filter for a cigarette, comprising an assembly of: a cylindrical filtering core; a tubular filtering sheath surrounding said core; and, between said core and said sheath, passages spaced circumferentially around said core and extending continuously between open ends at the two ends of the assembly.

When a filter-tipped cigarette using the filter is smoked, part of the smoke of the cigarette passes through the core and the sheath and subsequently is delivered to the smoker. The remaining part of the smoke is directly delivered to the smoker through the axial passages. Since the passages are provided between the core and the sheath, non-filtered smoke can easily reach the smoker's palate. As a result, even a small quantity of non-filtered smoke enables the smoker to enjoy the original taste and aroma of the cigarette. In other words, the taste and aroma of the cigarette are neither too strong nor too mild, and the smoker can enjoy the aroma and the flavor of the cigarette satisfactorily.

It is preferable that the sheath has a thickness of 1 to 3 mm, the ratio of the core diameter to the thickness of the sheath is 0.7 to 6, and there are 3 to 25 passages.

The axial air-flow resistance of the sheath may be different from that of the core, and the former is preferably higher than the latter. In this case, the quantity of smoke flowing in the core is larger than that flowing in the sheath.

The second object of the invention is accomplished by adding air introducing means to the above-mentioned filter. Ventilation air is introduced into the passages through the sheath and dilutes the smoke flowing in the passages so that the filter will provide the smoker a milder smoke.

The passages may be provided by longitudinal grooves at the outer peripheral surface of the core and/or the inner peripheral surface of the sheath.

When the core has the longitudinal grooves, these may be provided by thermoforming the outer peripheral surface of the core or using a corrugated wrapper or a tubular element at the outer peripheral surface of the core; the inner peripheral surface of the sheath may be formed by thermoforming the inner peripheral surface of the sheath or using an outer wrapper surrounding the core. In this case, the passages are defined between the longitudinal grooves of the core and the inner peripheral surface of the sheath. Air permeability may be imparted to both the inner and outer peripheral surfaces of the sheath so that ventilation air flows radially into the sheath and then into the passages.

When the sheath has the longitudinal grooves, these may be provided by thermoforming the inner peripheral surface of the sheath or using a corrugated wrapper or a tubular element at the inner peripheral surface of the sheath; the outer peripheral surface of the core may be formed by thermoforming the outer peripheral surface of the core or using a wrapper surrounding the core. In this case, the passages are defined between the outer peripheral surface of the core and the longitudinal grooves of the sheath. Air permeability may be imparted to both the inner and outer peripheral surfaces of the sheath, or air permeability may be imparted to the outer peripheral surface of the sheath and openings formed in the sheath in communication with the longitudinal grooves; in either this case, the ventilation air passes radially into the sheath from outside and then into the passages.

Using a cylindrical corrugated wrapper between the sheath and the core may form the passages between the corrugated wrapper and the sheath and between the corrugated wrapper and the core. In this case, the corrugated wrapper may or may not have air permeability.

The passages may be formed in a tubular element which is arranged between the core and the sheath. Air permeability may be imparted to the inner and outer peripheral surfaces of the sheath, with openings in the tubular element connecting the sheath to the passages.

The passages may have a total cross-sectional area of 1 to 3 $mm^2$. In this case, a desirable amount of non-filtered smoke flows in the passages.

The filter may include a cylindrical tip element, which may comprise a filter material. The tip element may have a length from 2 to 20 mm, which is correspondingly 8 to 60% of the overall length of the filter, and an axial air-flow resistance of 80 or less $mmH_2O$/25 mm. The tip element makes it easier to adjust the axial air-flow resistance of the whole filter.

The core and the sheath may be made from different materials or the same material. The filter material is preferably tow of cellulose acetate.

BRIEF DESCRIPTION OF DRAWINGS

Referring to FIG. 1, a filter-tipped cigarette has a cylindrical filter 4 at one end thereof. The filter 4 is connected to the cigarette 2 by winding a tipping paper 6 onto the filter 4 and one end of the cigarette 2. Perforations 8 are formed in the tipping paper 6. The perforations 8 are distributed in the circumferential direction of the filter 4 to provide air permeability to the tipping paper 6. Instead of the perforations 8, the tipping paper 6 itself may have air permeability.

Figure 1:
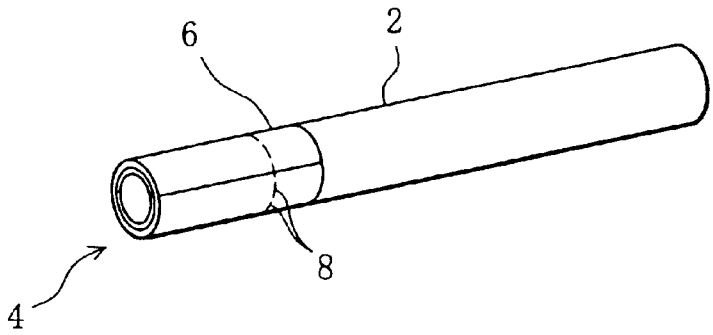
FIG. 1 is a perspective view of a filter-tipped cigarette.
Figure 2:
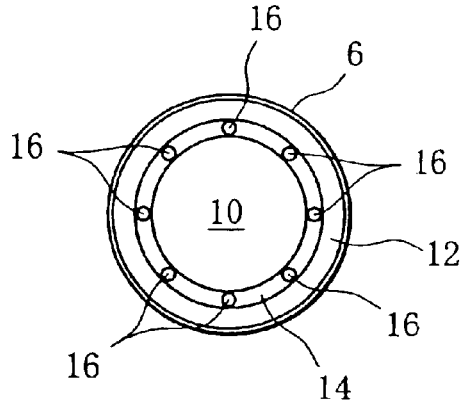
FIG. 2 is an end view of a filter.

As can be seen from FIG. 2, the filter 4 has a double structure and comprise a cylindrical core 10 and a cylindrical sheath 12 surrounding the core 10. The core 10 and the sheath 12 comprises filter material. Various kinds of material such as tow or sheet of cellulose acetate fibers, or a paper sheet, etc., can be used as the filter materials. Preferably, the core 10 and the sheath 12 are made of tow of cellulose acetate fibers. The axial air-flow resistances of the core 10 and the sheath 12, that is the resistances to draw (RTD) through the core 10 and the sheath 12, can be different from each other. RTD of the sheath 12 is preferably higher than that of the core 10.

Figure 3:
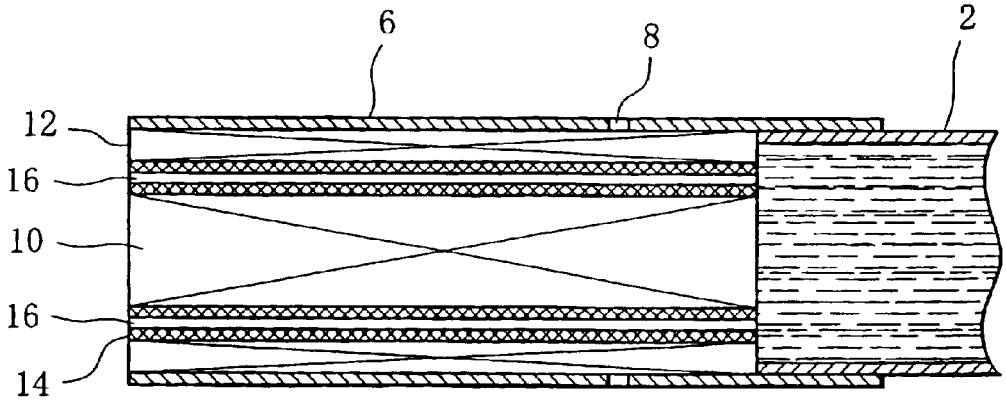
FIG. 3 is a longitudinal sectional view of the filter of FIG. 2.

The filter 4 has a boundary region 14 between the core 10 and the sheath 12. A plurality of axial passages 16 is formed in the boundary region 14. These passages 16 are distributed in the circumferential direction of the filter 4 and extend through the overall length of the filter 4 as shown in FIG. 3.

Preferably, the outer peripheral surface of the sheath 12 and the boundary region 14 have air permeability.

When the core 10 of diameter D and the sheath 12 are made of tow of cellulose acetate fibers, the number N and the overall cross-sectional area of the passages 16 are preferably 3 to 25 and 1 to 3 $mm^2$, respectively. The thickness T of the sheath 12 is preferably from 1 to 3 mm. D/T is preferably from 0.7 to 6. The total RTD of the filter 4 is preferably from 80 to 160 $mmH_2O$, more preferably 105 to 135 $mmH_2O$.

When the filter-tipped cigarette using the filter 4 is smoked, part of the smoke of the cigarette 2 is directly delivered to the smoker through the axial passages 16. The remaining part of the smoke passes through the core 10 and the sheath 12 and is then delivered to the smoker. The non-filtered smoke locally spreads within the mouth of the smoker. As a result, an adequate feeling of the smoke of the cigarette 2 can be provided to the smoker even if the quantity of non-filtered smoke is small. The smoker therefore can enjoy flavor and scent of the cigarette 2 itself.

Part of the tar and nicotine contained in the smoke passing through the core 10 and the sheath 12 is caught by the filter materials of the core 10 and the sheath 12 so that a mild smoke can be provided to the smoker.

When the outer peripheral surface of the sheath 12 and the boundary region 14 have air permeability, ventilation air is introduced into the sheath 12 through the perforations 8 of the tipping paper 6 during smoking of the filter-tipped cigarette. A part of the ventilation air is further introduced into the axial passages 16 through the boundary region 14. The smoke passing through the axial passages 16 is therefore diluted with the ventilation air, and the smoking feeling is further milder. As a result, the quantity of non-filtered smoke directly delivered to the smoker can be reduced, and the tar and nicotine delivered to the smoker are further reduced.

The amount of ventilation air introduced into the filter 4 through the perforations 8, that is the degree $V_F$ of filter ventilation, is desirably from 30 to 80% of the total flow (including the smoke of the cigarette 2) sucked by the smoker through the filter-tipped cigarette.

Since the filter 4 has the double structure of the core 10 and the sheath 12, it is possible to independently determine the RTDs and smoke filtering efficiencies of the core 10 and the sheath 12. As a result, degrees of freedom with respect to the amounts of tar and nicotine delivered by the filter-tipped cigarette are increased.

The dilution ratio of the smoke passing through the axial passages 16 can be also controlled by adjusting the RTD of the sheath 12 and the air permeability of the boundary region 14. Further, adjustments of the total opening area of the perforations 8 and the air permeability of the outer peripheral surface of the sheath 12 can also control the dilution ratio. Accordingly, the degree of freedom in the dilution ratio control of the non-filtered smoke can be also greatly increased.

The axial passages 16 of the boundary region 14 can be formed by longitudinal grooves formed at the outer peripheral surface of the core 10 or the inner peripheral surface of the sheath 12. Further, the axial passages 16 can be formed in a tubular element arranged between the core 10 and the sheath 12.

Whilst the non-filtered smoke in the axial passages 16 can be diluted with ventilation air, this is not essential, so that the outer peripheral surface of the sheath 12 and the boundary region 14 are therefore not necessarily air permeable in which case perforations 8 may also be omitted.

Embodiments of the filter will next be explained, in which tow of cellulose acetate fibers is commonly used as the filter material of the core 10 and the sheath 12.

Grooved Core Type

Embodiment 1

Figure 4:
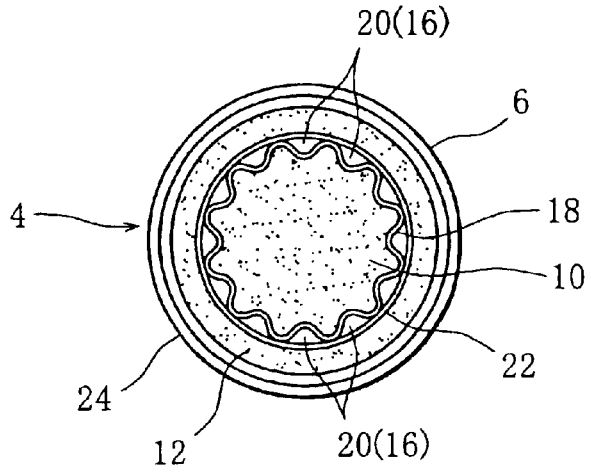
FIG. 4 is an end view of a filter in accordance with an embodiment 1.
Figure 5:
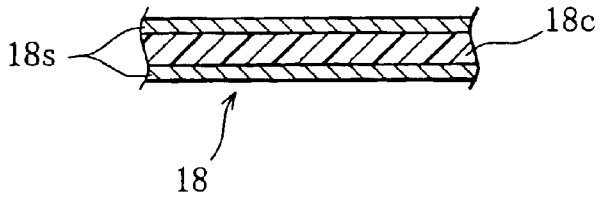
FIG. 5 is across-sectional view of the corrugated wrapper of FIG. 4.

In the filter 4 of FIG. 4, tow of the core 10 is wrapped in a corrugated wrapper 18. The corrugated wrapper 18 provides a corrugated outer peripheral surface to the core 10. The outer peripheral surface of the core 10 has therefore a plurality of longitudinal grooves 20 extending in the axial direction of the filter 4. The number of longitudinal grooves 20 is suitably 4 to 17. The longitudinal grooves 20 suitably have a depth of 0.15 to 0.45 mm. As shown in FIG. 5, the corrugated wrapper 18 is preferably made of a laminated paper which may have a three-layer structure. For example, the laminated paper has a polyethylene layer 18*c* and pulp layers 18*s* laminated on both sides of the layer 18*c*. The laminated paper can be easily shaped into the corrugated wrapper 18 by thermal molding. The corrugated wrapper 18 is not limited to laminated paper. Various kinds of paper and other materials can be used for the corrugated wrapper.

An outer wrapper 22 surrounding the corrugated wrapper forms the inner peripheral surface of the sheath 12. The outer wrapper 22 and the longitudinal grooves 20 define the axial passages 16. The outer wrapper 22 preferably has air permeability. For example, the outer wrapper 22 can be of highly porous paper (2000 CU, i.e., 2,000 Coresta units).

Tow of the sheath 12 is wrapped in a plug wrapper 24 having air permeability. The plug wrapper 24 forms the outer peripheral surface of the sheath 12. Plug wrapper for a normal filter rod is used as the plug wrapper 24.

The RTDs of the core 10 (including the axial passages 16) and the sheath 12 in the axial direction of the filter 4 are respectively denoted by references $P_{CA}$ and $P_S$. In this case, the ratio R1 ($=P_S/P_{CA}$) is from 0.3 to 4.0 and is preferably about 2.0. For example, when the ratio R1 is about 2, tow specifications of the core 10 and the sheath 12 are respectively about 1.7/38000 (i.e., 1.7 filament denier/38,000 total denier; this applies to similar expressions appearing hereinafter unless otherwise specified) and about 5/55000. The tow specifications of the core 10 and the sheath 12 can be respectively selected from a range of 1.5/38000 to 5/17000 and a range of 2.5/45000 to 5/55000.

When the filter 4 of FIG. 4 is manufactured, tow for the core 10 is first wrapped in the corrugated paper so that a core rod is formed. Thereafter, the core rod is further wrapped in the outer wrapper. Tow for the sheath 12 envelopes the outer side of the outer wrapper. The tow for the sheath 12 is wrapped in the plug wrapper so that a filter rod is formed. The filter 4 can be obtained by cutting the filter rod to a predetermined length.

Embodiment 2

Figure 6:
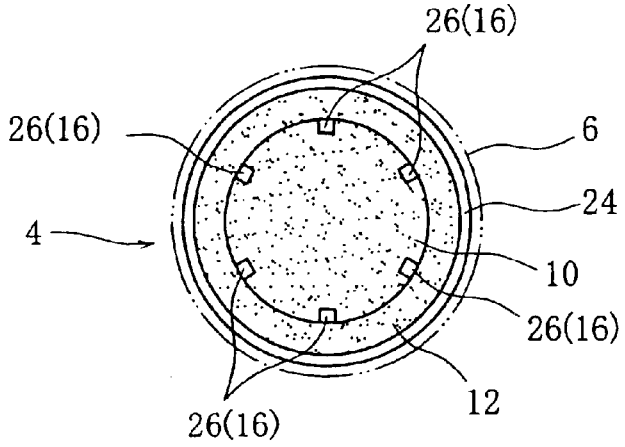
FIG. 6 is an end view of a filter in accordance with an embodiment 2.

In the case of filter 4 of FIG. 6, the outer peripheral surface of the core 10 is formed by thermoforming. The thermoforming forms a plurality of longitudinal grooves 26 on the outer peripheral surface of the core 10. These longitudinal grooves 26 extend in the axial direction of the core 10.

The sheath 12 has an inner peripheral surface formed by thermoforming or a core outer wrapper. The inner peripheral surface of the sheath 12 has air permeability. The inner peripheral surface of the sheath 12 and the longitudinal grooves 26 define the axial passages 16. The outer peripheral surface of the sheath 12 is formed by wrapping tow of the sheath 12 in a plug wrapper 24 having air permeability, or is formed by thermoforming. The filter 4 of FIG. 6 also has the above-mentioned ratio R1 ($=P_S/P_{CA}$).

When the outer peripheral surface of the core 10 or the inner or outer peripheral surface of the sheath 12 is thermoformed, it has air permeability. For example, the filter 4 of FIG. 6 can be obtained by using the manufacturing technique disclosed in U.S. Pat. No. 4,022,2221, so that the filter 4 has the core 10 with the longitudinal grooves 26 and the sheath 12.

Embodiment 3

Figure 7:
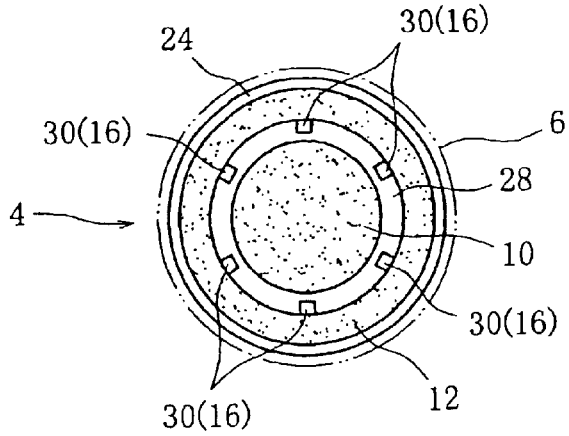
FIG. 7 is an end view of a filter in accordance with an embodiment 3.

In the case of filter 4 of FIG. 7, a tubular element 28 is a boundary region between the core 10 and the sheath 12. A plurality of longitudinal grooves 30 is formed on the outer peripheral surface of the tubular element 28. The tubular element 28 is made of synthetic resin such as polypropylene, polyethylene, etc. or of biodegradable polymer such as acetate, etc.

The sheath 12 has an air permeable inner peripheral surface formed by thermoforming or by an outer wrapper around element 28. The inner peripheral surface of the sheath 12 and the longitudinal grooves 30 define the axial passages 16. A plug wrapper or thermoforming can form the outer peripheral surface 24 of the sheath 12. The filter 4 of FIG. 7 also has the above-mentioned ratio R1 ($=P_S/P_{CA}$).

The filter 4 of FIG. 7 can be manufactured by guiding tow for the core 10 into the tubular element 28 together with extrusion molding of the tubular element 28 and then forming the sheath 12 outside the tubular element 28.

Grooved Sheath Type

Embodiment 4

Figure 8:
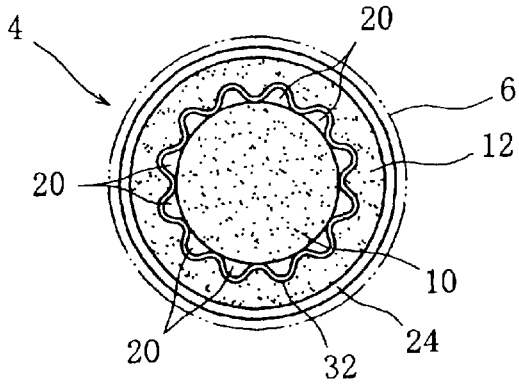
FIG. 8 is an end view of a filter in accordance with an embodiment 4.

In the case of filter 4 of FIG. 8, a corrugated wrapper 32 having air permeability forms an inner peripheral surface of the sheath 12. In this case, thermoforming or a wrapper having air permeability forms the outer peripheral surface of the core 10. The corrugated wrapper 32 is wound around the outer peripheral surface of the core 10. The axial passages 16 are therefore defined between the corrugated wrapper 32 and the outer peripheral surface of the core 10. Tow of the sheath 12 surrounds the outer side of the corrugated wrapper 32 and thermoforming or the plug wrapper forms the outer peripheral surface 24 of the sheath 12.

Embodiment 5

Figure 9:
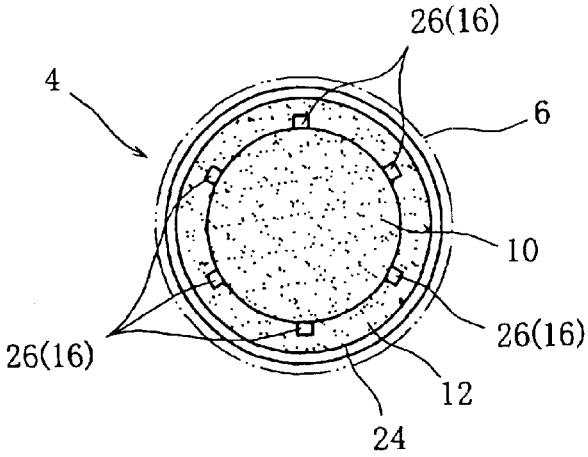
FIG. 9 is an end view of a filter in accordance with an embodiment 5.

In the case of filter 4 of FIG. 9, thermoforming forms the inner peripheral surface of the sheath 12 with longitudinal grooves. In this case, thermoforming or a wrapper having air permeability forms the outer peripheral surface of the core 10. The other structural feature of the filter 4 of FIG. 9 are similar to those of the filter of FIG. 6.

In the case of the filter 4 of FIG. 9, the RTDs of the core 10 and the sheath 12 (including the axial passages 16) are respectively denoted as references $P_C$ and $P_{SA}$. In this case, the ratio R2 ($=P_{SA}/P_C$) is preferably from 0.2 to 0.4. For example, when the ratio R2 is about 0.3, tow specifications of the core 10 and the sheath 12 are respectively about 5/35000 and about 7/68000. The tow specifications of the core 10 and the sheath 12 can be selected from respective ranges of 2.8/31000 to 7/34000 and 2.0/36000 to 7/68000.

Embodiment 6

Figure 10:
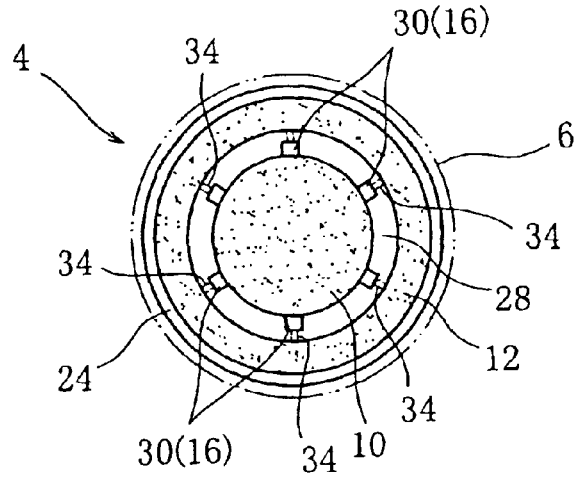
FIG. 10 is an end view of a filter in accordance with an embodiment 6.

In the case of filter 4 of FIG. 10, longitudinal grooves 30 are formed on the inner peripheral surface of the tubular element 28 and each has a communication hole 34 communicating with sheath 12. The communication holes 34 can therefore guide ventilation air introduced into the sheath 12 into the longitudinal grooves 30. The other structural feature the filter 4 of FIG. 10 are similar to those of the filter of FIG. 7.

Composite Type

Embodiment 7

Figure 11:
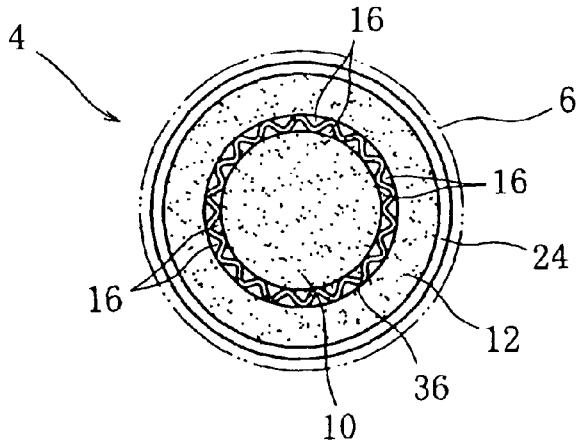
FIG. 11 is an end view of a filter in accordance with an embodiment 7.

In the case of the filter of FIG. 11, thermoforming or a wrapper having air permeability forms the outer peripheral surface of the core 10 and the inner peripheral surface of the sheath 12. A corrugated wrapper 36 is arranged between the core 10 and the sheath 12. The corrugated wrapper 36 forms axial passages 16 with the outer peripheral surface of the core 10 and the inner peripheral surface of the sheath 12. In this case, the corrugated wrapper 36 may be air permeable or impermeable. When the corrugated wrapper 36 is not air permeable, the non-filtered smoke passing through the axial passages 16 at the inner peripheral surface of the sheath 12 is diluted with ventilation air, whereas that passing through the other passage is not. Thermoforming or a plug wrapper forms the outer peripheral surface 24 of the sheath 12.

Tube Type

Embodiment 8

Figure 12:
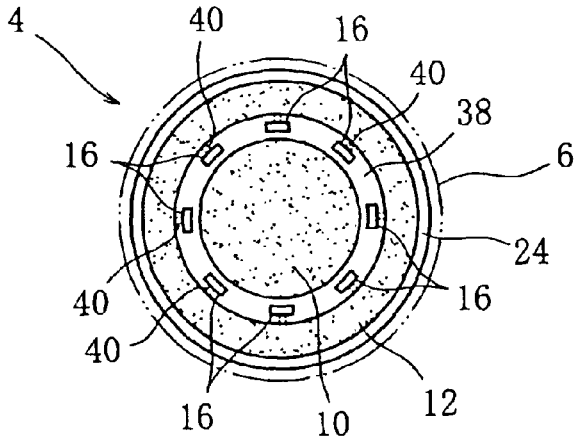
FIG. 12 is an end view of a filter in accordance with an embodiment 8.

In the case of the filter 4 of FIG. 12, a tube 38 is arranged between the core 10 and the sheath 12 and has the axial passages 16 therein. Similar to the case of the above-mentioned tubular element 28, the tube 38 is made of synthetic resin such as polypropylene, polyethylene, etc., or biodegradable polymer such as acetate, etc. Holes 40 in tube 38 give communication between axial passages 16 and sheath 12. Thermoforming or a plug wrapper forms the outer peripheral surface 24 of the sheath 12.

In this case, the ratio R1 of the RTD of the sheath 12 to that of the core 10 is preferably about 2.0. Tow specifications of the core 10 and the sheath 12 are respectively from 1.5/3800 to 5/17000 and 2.5/45000 to 5/50000.

The filter 4 of FIG. 12 is manufactured by introducing tow for the core 10 into the tube 38 together with extrusion molding of the tube 38 and forming the sheath 12 outside the tube 38.

Figure 13:
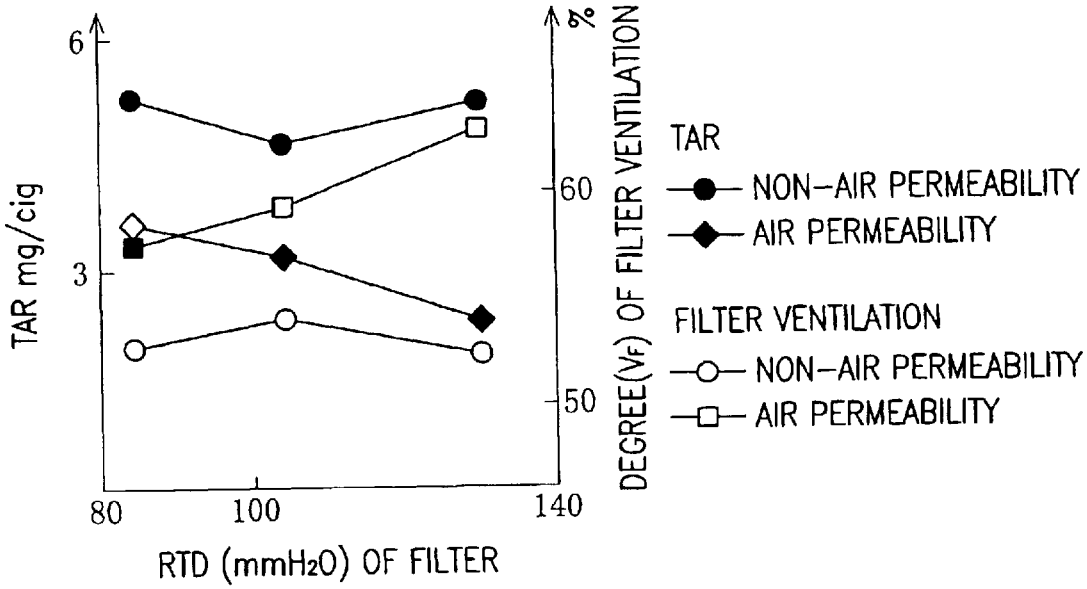
FIG. 13 is a graph showing the results of a smoking test of a filter-tipped cigarette.
Figure 14:
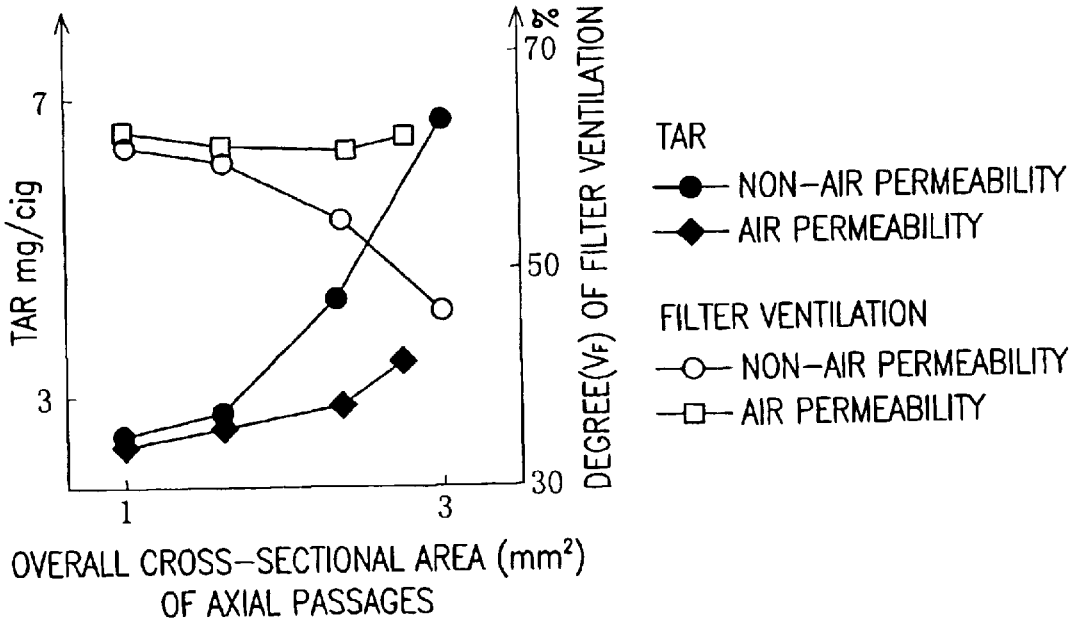
FIG. 14 is a graph showing the results of a smoking test of a filter-tipped cigarette.

FIGS. 13 and 14 show the results of a smoking test with respect to a filter-tipped cigarette having the above filter 4.

When there is no air permeability between the sheath 12 and the axial passages 16, the degree $V_F$(○) of filter ventilation hardly changed with change of total RTD of the filter 4, as clearly seen from FIG. 13, and the discharge of tar (●) from the filter 4 is also not changed much. However, when there is air permeability between the sheath 12 and the axial passages 16, the degree $V_F$(□) of filter ventilation increases as the RTD of the filter 4 is increased, and the discharge (♦) of tar is greatly reduced.

The increase in the degree $V_F$ of filter ventilation means that more ventilation air is introduced into the axial passages 16 through the sheath 12. The non-filtered smoke passing through the axial passages 16 is thus more diluted with the ventilation air. As a result, the amount of the non-filtered smoke delivered to a smoker is reduced and the amount of tar discharged from the filter-tipped cigarette is reduced.

Accordingly, it is desirable to secure the air permeability between the sheath 12 and the axial passages 16 and increase the RTD of the filter 4 so as to reduce the amount of tar discharged. When the RTD of the filter 4 is excessively increased, however, it becomes too difficult for the smoker to draw.

The amount of tar discharged is also greatly changed in accordance with the above-mentioned resistance ratio R. As a result of the smoking test, it is confirmed that the amount of tar discharged is increased as the resistance ratio R is increased. This is because the RTD of the core 10 is reduced and the amount of the non-filtered smoke passing through the axial passages 16 is increased so that the tar-filtering effect of the core 10 is reduced.

FIG. 14 similarly shows the relation between the amount of tar discharged, the degree $V_F$ of filter ventilation, and the overall cross-sectional area of the axial passages 16. As clearly seen from FIG. 14, when there is no air permeability between the sheath 12 and the axial passages 16 and the overall cross-sectional area of the axial passages 16 is increased, the degree $V_F$(○) of filter ventilation is reduced and the discharge (●) of tar is increased. In contrast to this, when there is air permeability between the sheath 12 and the axial passages 16, the degree $V_F$(□) of filter ventilation is not changed so much and the discharge (♦) of tar is gradually increased even if the overall cross-sectional area of the axial passages 16 is increased. The amount of tar discharged can therefore be controlled with high accuracy by adjusting the overall cross-sectional area of the axial passages 16.

Accordingly, in accordance with the filter 4 of the present invention, changing the RTD and the resistance ratio R of the filter 4 and the overall cross-sectional area of the axial passages 16 can control the amount of tar discharged. Further, the degree of freedom of this control is very high. As a result, it is possible to easily obtain a filter-tipped cigarette having an amount of tar discharged equal to or smaller than 3 mg, for example.

According to the result of the smoking test, the ratio of CO to tar (C/T) in the filter-tipped cigarette having the filter 4 is reduced in comparison with a normal filter-tipped cigarette.

Figure 15:
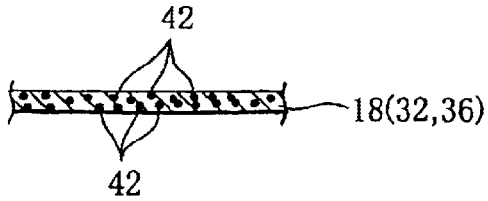
FIG. 15 is a cross-sectional view showing a modified example of the corrugated wrapper.
Figure 16:
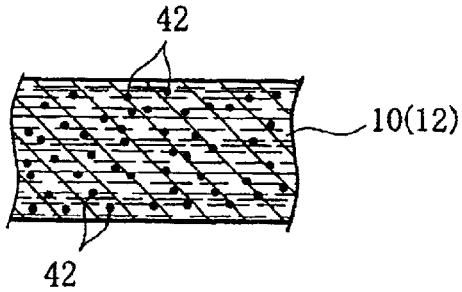
FIG. 16 is a view showing modified examples of a core and a sheath.

As shown in FIG. 15, each of above corrugated wrappers 18, 32 and 36 may be made of charcoal paper in which particles 42 of activated carbon are uniformly distributed in paper material having air permeability. Particles 42 of activated carbon may be uniformly distributed within tow of the core 10 or the sheath 12 as shown in FIG. 16. The particles 42 of activated carbon within the corrugated wrapper, the sheath or the core adsorb vapor phase components in the smoke from the cigarette 2.

Figure 17:
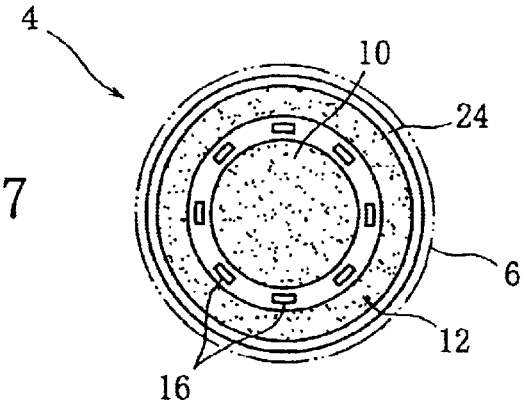
FIG. 17 is an end view of a filter shown as a modified example.

The communication holes 40 of the tube 38 of FIG. 12 can be omitted as shown in FIG. 17. In this case, it is impossible to introduce ventilation air into the axial passages 16 in the tube 38 to dilute the non-filtered smoke passing through the axial passages. The filter of FIG. 17 has, however, advantages in that the interior of the filter has the double structure of the core 10 and the sheath 12.

FIG. 17 shows only one example in which the passages 16 are not ventilated. In each of the embodiments of FIGS. 4, 6 to 8, 10 and 11, the inner peripheral surfaces of the sheath 12 and the corrugated wrapper 18 may be air-impermeable, and the communication holes 34 of the tube element 28 can be omitted. Further, when passages 16 are not to be ventilated, the outer peripheral surface of the sheath 12 may be air-permeable in each of the embodiments of FIGS. 4 and 6 to 11, and air permeability of the tipping paper 6 is also not required.

Figure 18:
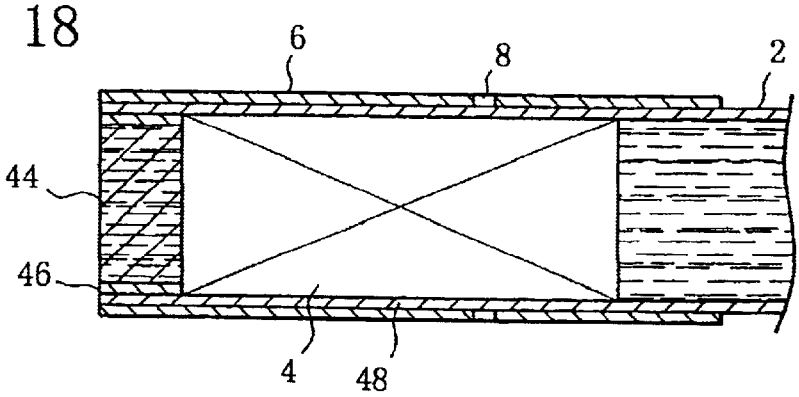
FIG. 18 is a view showing a modified example of the filter-tipped cigarette.

As shown in FIG. 18, the filter 4 may abut a tip element 44. For example, the tip element 44 is a so-called plain filter element formed by wrapping tow of cellulose acetate fibers in a plug wrapper 46. The tip element 44 is in close contact with the end face of the filter 4 away from cigarette 2 and has a length from 2 to 20 mm, which is 8 to 60% of the total length of the filter 4 and the tip element 44. The tip element 44 has 80 $mmH_2O$/25 mm as the maximum RTD thereof. It is desirable that the length of the tip element 44 is as short as possible to retain the original function of the filter 4. However, if the RTD of the tip element 44 is reduced, the length of the tip element 44 can be adjusted for ease of manufacture and assembly with element 44.

The filter 4 and the tip element 44 are connected by connecting paper 48 to form a dual filter. The dual filter is connected to cigarette 2 by tipping paper 6. The connecting paper 48 has air permeability when there is to be ventilation of the filter.

In accordance with the filter-tipped cigarette of FIG. 18, the tip element 44 is added to the filter so that the total RTD of the filter (including the tip element 44) may be controlled by the tip element 44. When particles 42 of activated carbon are included within the core 10 and the sheath 12 of the filter 4, the tip element 44 prevents dropping of the particles 42 of activated carbon.

Further, a plain filter element or a charcoal filter element containing particles of activated carbon can be arranged instead of the tip element 44 between the filter 4 and the cigarette 2. Further, the tip element 44 or the filter element may be respectively arranged at both ends of the filter.

What is claimed is:

1. A filter for a cigarette, comprising an assembly of a cylindrical core for filtering tobacco smoke from the cigarette;

a tubular sheath made of filtering material selected from a tow or sheet of cellulose acetate fibers for filtering tobacco smoke from the cigarette, said tubular sheath surrounding said core, and provided between said core and said sheath are passages, wherein said passages are spaced circumferentially around said core and extending continuously between open ends at the two ends of the assembly, and a tipping paper circumferentially surrounding said sheath.

2. The filter according to claim 1, wherein said sheath has a thickness of 1 to 3 mm, such that a ratio of a diameter of said core to the thickness of said sheath is from 0.7 to 6.

3. The filter according to claim 1, wherein said sheath has an axial air-flow resistance higher than that of said core.

4. The filter according to claim 1, further comprises means for introducing air into said passages through said sheath.

5. The filter according to claim 1, wherein said core has a plurality of longitudinal grooves at an outer peripheral surface thereof, and said passages are defined between the longitudinal grooves and an inner peripheral surface of said sheath.

6. The filter according to claim 5, wherein the longitudinal grooves are provided by a thermoformed outer peripheral surface of said core or by a corrugated wrapper or a grooved tubular element at the outer peripheral surface of said core.

7. The filter according to claim 6, wherein both the inner and outer peripheral surfaces of said sheath are air permeable.

8. The filter according to claim 1, wherein said sheath has a plurality of longitudinal grooves at an inner peripheral surface thereof, and said passages are defined between the longitudinal grooves and an outer peripheral surface of said core.

9. The filter according to claim 8, wherein the longitudinal grooves are provided by a thermoformed inner peripheral surface of said sheath or by a corrugated wrapper or a grooved tubular element at the inner peripheral surface of said sheath.

10. The filter according to claim 9, wherein both the inner and outer peripheral surfaces of said sheath are air permeable.

11. The filter according to claim 1, further comprises a cylindrical corrugated wrapper arranged between said core and said sheath, said passages being defined between said corrugated wrapper and said core and between said corrugated wrapper and said sheath.

12. The filter according to claim 1 further comprises a tubular element arranged between said core and said sheath and having said passages therein.

13. The filter according to claim 12, wherein both the inner and outer peripheral surfaces of said sheath are air permeable, and openings are formed in said tubular element in communication with said passages.

14. The filter according to claim 1, wherein the passages have a total cross-sectional area of 1 to 3 $mm^2$.

15. The filter according to claim 1, wherein the assembly is in longitudinal alignment with a cylindrical tip element, said tip element having a length from 2 to 20 mm which is correspondingly from 8 to 60% of an overall length of said filter, and an axial air-flow resistance of 80 or less $mmH_2O$/25 mm.

16. The further according to claim 1, wherein said tipping paper is air permeable.

17. The filter according to claim 1, wherein said passages are 3 to 25.

18. The filter according to claim 9, wherein the outer peripheral surface of said sheath is air-permeable, and openings arm formed in said tubular element in communication with the longitudinal grooves.

19. The filter according to claim 1, wherein air flows radially within said sheath.

* * * * *